United States Patent [19]

Moeller

[11] 4,097,975

[45] Jul. 4, 1978

[54] NOZZLE ASSEMBLY FOR TEXTURING SYNTHETIC FILAMENTS

[75] Inventor: Norbert Möeller, Berlin, Fed. Rep. of Germany

[73] Assignee: Heberlein Maschinenfabrik AG, Wattwil, Switzerland

[21] Appl. No.: 816,948

[22] Filed: Jul. 19, 1977

[30] Foreign Application Priority Data

Jul. 29, 1976 [DE] Fed. Rep. of Germany ..... 2634460

[51] Int. Cl.[2] ..... D02G 1/16

[52] U.S. Cl. ..... 28/254; 28/271; 28/273; 57/34 B; 57/157 F

[58] Field of Search ..... 28/254, 271, 272, 273, 28/274, 275, 220; 57/34 B, 157 R, 157 F

[56] References Cited

U.S. PATENT DOCUMENTS

| | | | |
|---|---|---|---|
| 2,638,146 | 5/1953 | Rounseville et al. | 28/271 |
| 3,688,358 | 9/1972 | Kashima | 28/254 |
| 3,835,510 | 9/1974 | Koslowski | 28/254 |
| 3,881,231 | 5/1975 | Price et al. | 28/254 |
| 3,911,655 | 10/1975 | London et al. | 28/271 X |

*Primary Examiner*—Louis K. Rimrodt
*Attorney, Agent, or Firm*—Larson, Taylor & Hinds

[57] ABSTRACT

Nozzle assemblies for texturing one or several yarns consisting of a plurality of endless synthetic filaments are described wherein the yarn passes through a whirling chamber, fed laterally through at least one oblique bore with compressed air, into a nozzle with a spherical guide element located in the divergent part of the nozzle so as to define therewith an annular slot in which the spreading air stream from the whirling chamber is accelerated. The whirls and loops formed in the individual filaments are subjected to increased whirling by the deflection of the air stream by the guide element, which is mounted for both axial and lateral adjustment in the nozzle. The guide element may present a hemispherical surface towards the whirling chamber or, alternatively, a frusto-spherical surface with a central concavity. The yarn is withdrawn laterally from the air stream beyond the nozzle.

9 Claims, 2 Drawing Figures

NOZZLE ASSEMBLY FOR TEXTURING SYNTHETIC FILAMENTS

FIELD OF THE INVENTION

The present invention relates to a nozzle assembly for texturing one or several yarns consisting of a plurality of endless synthetic filaments.

DESCRIPTION OF THE PRIOR ART

A nozzle arrangement described in German published patent application (Offenlegungsschrift) No. 2,605,806 has at least one radially oriented passage ending in the whirling chamber and serving for the feeding of compressed air and an extension connected with the whirling chamber which forms a passage which is preferably coaxial with the whirling chamber, the width of the passage being larger than the conical spread of the stream of air formed as it passes through the passage. By so shaping the assembly, in comparison with other known nozzle arrangements, when processing a single yarn consisting of a plurality of endless synthetic filaments to obtain a textured yarn and employing an optimally low air consumption, the resulting yarn has such a low resistance to tensile strain that it scarcely keeps its textured character during subsequent processing.

SUMMARY OF THE INVENTION

It is the purpose of the present invention so to improve the aforesaid nozzle arrangement that, while maintaining an optimally low air consumption in the yarn leaving the nozzle, a more intense entanglement in the whirls and loops formed in the filaments is obtained, as a consequence of which a better resistance to tensile strain is imparted to the yarn.

This is achieved according to the present invention by a guide element mounted in the outlet end of a nozzle connected to a whirling chamber, said nozzle being preferably of conical shape, said guide element forming in the passage through said nozzle an annular slot serving to accelerate the stream of air, and said guide element being formed with a half-spherical surface facing towards the whirling chamber from which it is spaced.

It has been found that, by the arrangement of the guide element within the passage through the nozzle connected to the whirling chamber surprisingly, a further improvement and increase of the loop formation in the individual filaments and more intimate and more compact mutual penetration of these loops is achieved so that the textured yarn leaving the nozzle connected to the whirling chamber has an increased solidity which better resists the tensile strain that arises during the succeeding processing of the textured yarn. This unexpected improvement of texturization is probably due to the fact that the whirls and loops formed in the individual filaments in the whirling chamber are subjected to increased whirling in the nozzle connected with the whirling chamber by deflection of the air stream by the guide element which leads to increased mutual fixation of the individual filaments. This increased whirling occurs in the space within the nozzle lying upstream of the guide element; the spread cone of the air stream issuing from the whirling chamber is freely guided to the hemi-spherical surface of the guide element in a funnel-like current formed between the inlet end of the nozzle connected with the whirling chamber and the guide element, the textured yarn being supported in the annular slot by floating in the air stream. The air stream, together with the textured yarn, experiences an additional acceleration serving to solidify the loops mutually in the narrowest part of the annular slot.

After having passed through the narrowest part of the annular slot, the textured yarn emerges from the annular slot, the width of which gets successively larger towards the outer end of the nozzle so that it can be removed from the nozzle without any mechanical influence acting thereon.

Preferably the annular slot, where its width is narrowest has a cross-sectional area which is no longer than the cross-sectional area of the whirling chamber. By this measure, the air stream is caused to undergo substantial acceleration in the narrowest part of the annular slot.

Preferably also the diameter of the surface of the guide element, at the location of the smallest width of the annular slot, corresponds to the diameter of the spread cone of the stream of air. Due to the fact that the surface of the semispherical guide element is in interior tangential contact with the spread cone of the stream of air, a disturbance-free deflection of the stream of air is produced in the annular slot between the nozzle connected with the whirling chamber and the guide element so that the textured yarn is guided without any disturbance past the guide element and through the annular slot.

Advantageously, the guide element is made adjustable in the direction of the axis of the nozzle. By the adjustment of the guide element axially with respect to the nozzle, the annular slot between the nozzle and the guide element can be modified so far as its width is concerned, to adapt the position of the guide element to the existing operation parameters, namely the type and titer of the yarn and to the speed of the stream of air. Furthermore, preferably the guide element is adjustable in a plane to which the axis of the nozzle is perpendicular. By this measure, the annular slot between the nozzle and the guide element can be adjusted to the smallest value at a specific point, namely at the required output point of the textured yarn so that the stream of air has a maximum speed at this narrowest point of the annular slot and so that the textured yarn issues from the nozzle at this point.

The nozzle and whirling chamber may be supported by a body on which is arranged a support carrying a member supporting the guide element. This support has a journal received in the body in axial parallelism to the nozzle, the journal being axially adjustable and rotatable. The member supporting the guide element may be shaped so that axial adjustment of the guide element in the nozzle is achieved in a simple manner. Furthermore, it is possible to remove the guide element from the nozzle connected with the whirling chamber by rotation of the support if this should be necessitated by the quality of the material to be processed.

The member carrying the guide element may be a U-shaped member which carries the guide element on one of its limbs and has the other limb fixed on the support to be adjustable transversely with respect to the nozzle. By this measure, it is possible to adjust the guide element upwards with respect to the axis of the nozzle.

The guide element is preferably in the shape of a sphere, the half of which facing away from the whirling chamber, is fixed in a short tube having the diameter of the sphere.

DESCRIPTION OF THE DRAWINGS

In order that the invention may be clearly understood and readily carried into effect, devices in accordance therewith will now be described, by way of example, with reference to the accompanying drawings in which:

Referring to FIG. 1 a duct 1 has a guide passage 2 into which yarn 7 to be textured is introduced. From the guide passage 2, the yarn reaches a whirling chamber 3 of larger diameter which is fed with compressed air through at least one radially oriented bore 4, inclined towards the outlet end of the whirling chamber, the filaments of the yarn 7 being whirled together by the compressed air. The whirled yarn and the current of air enter a nozzle 9 which leads from the whirling chamber 3. The passageway 11 of this nozzle has along its length a cross-sectional area which is larger than that of the spread cone of the air stream emanating from whirling chamber 3.

Figure 1:
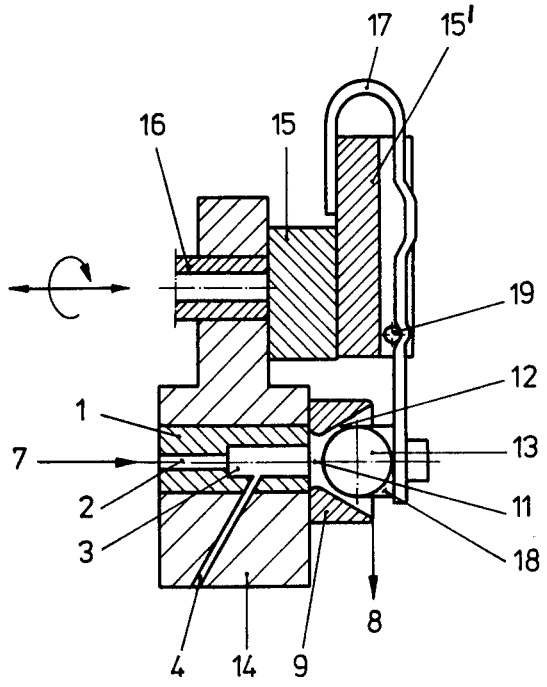
FIGS. 1 and 2 show sectional elevations respectively of two nozzle assemblies.

In the nozzle 9, there is a guide element 13 which has a hemispherical surface facing the whirling chamber 3, and which forms an annular slot 12 with the conical passageway 11 of the nozzle 9. This annular slot has a section of least width from which the slot expands outwardly. After passage through the section of least width in the air slot 12, the textured yarn 8 emerges from the air stream in the expanding annular slot so that the yarn can be pulled away downwardly from the lower rim of the nozzle 9.

The guide element 13 is carried by a support 15 which is mounted on a journal 16 in a bearing in a body 14 carrying the nozzle 1. The journal 16 is parallel to the axis of nozzle 1 and is adjustable in the body 14 both lengthwise and for rotation. By longitudinal adjustment of the journal 16, the shape and the width of the annular slot 12 can be modified in the passageway 11 of the nozzle 9 and thereby adapted to given operation parameters. By rotation of the axis 16, the guide element 13 can be removed from the nozzle 9. On an attachment 15' on the support 15, there is mounted a U-shaped member 17. The member 17 supports, at the end of its longer limb, the guide element 13 which is contained in a short tube 18 the diameter of which corresponds to the diameter of the guide element 13. The member 17 preferably consists of resilient material and its limb supporting the guide body 13 bears against a pin 19. To remove the guide element 13 from the nozzle 9, the limb of member 17 is lifted off the pin 19, and, at the same time, the journal 16 is rotated. The shorter limb of member 17 is arranged on the attachment 15' of support 15 perpendicular with respect to the axis of nozzle 1. Thereby, adjustment of the guide element 13 is possible transversely with respect to the axis of nozzle 1.

Figure 2:
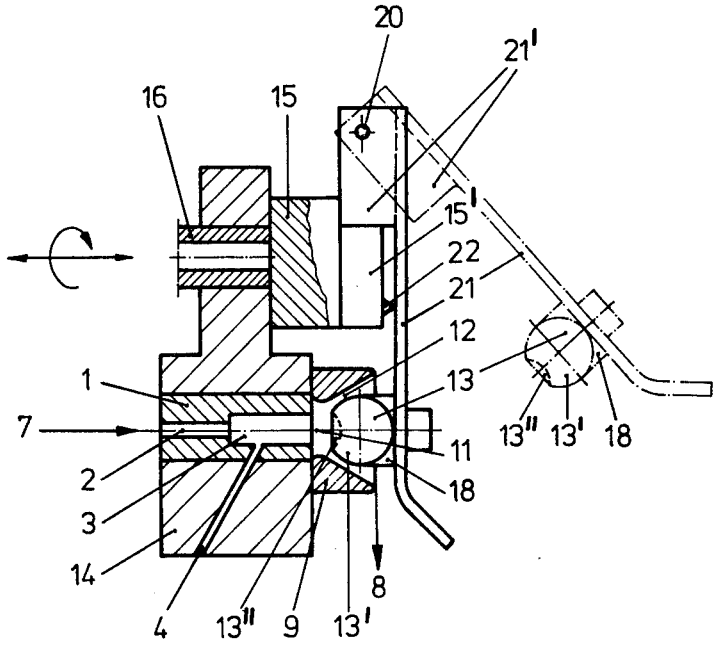

FIG. 2 shows a similar embodiment of the invention, but the half of the guide element 13 facing the whirling chamber 3 has the shape of a spherical zone 13' with a concave cavity 13''. Thus the spherical surface 13' is presented by a frustum of a sphere based on a great circle on the sphere.

The cavity 13'' serves to increase additionally the already increased whirling effect in the space situated upstream of the guide element 13 without impeding the path of the textured yarn 8 in the annular slot 12.

Instead of a U-shaped member, in the embodiment shown in FIG. 2, a lever 21 pivotable about an axis 20 is provided. A short tube 18 carrying the guide element 13 is fixed at the free end of the lever 21. Flanges 21' on the lever 21 bear resiliently on lateral faces on attachment 15'. In its operative position, the lever 21 is located by an abutment 22.

In each nozzle assembly shown in the Figures, the slot 12 has a least area, i.e. at the location of minimum width, that is no larger than the cross-sectional area of the whirling chamber. Moreover, the diameter of the surface of the guide element at that location corresponds to the diameter at that location of the conical stream of air emanating from the whirling chamber.

I claim:

1. A nozzle assembly for texturing at least one yarn consisting of a plurality of endless synthetic filaments, said assembly comprising a member formed substantially coaxially with a guide passage and a whirling chamber, having a larger cross-section than said guide passage, and also formed with at least one bore radially communicating with said whirling chamber for conveying compressed air into said whirling chamber, whereby yarn while passing in sequence through said guide passage and said whirling chamber is textured in said whirling chamber, said whirling chamber and said bore being arranged for the air to emerge from said chamber in the same direction as the yarn and as a spreading stream, a nozzle member extending coaxially from said whirling chamber and formed with an expanding passageway of greater cross-section than the spreading conical stream of air, a guide element formed with a spherical surface and means mounting said guide member with said spherical surface spaced from and facing towards said whirling chamber, said guide element being mounted in said expanding passageway to define therewith an annular slot serving to guide and accelerate the air stream as it passes therethrough, the arrangement being such that the yarn also is delivered through said slot.

2. A nozzle assembly according to claim 1, in which said annular slot at its location of least width has a cross-sectional area smaller than that of said whirling chamber, said whirling chamber having a substantially uniform cross-sectional area.

3. A nozzle assembly according to claim 1, in which the diameter of said surface of said guide element at the location of the smallest width of said annular slot corresponds to the diameter of the conical stream of air at that location.

4. A nozzle assembly according to claim 1, in which said mounting means enables said guide element to be adjusted in position along the axis of said nozzle.

5. A nozzle assembly according to claim 4, including a body supporting said nozzle and formed with a journal bearing in axial parallelism with the axis of said nozzle, said mounting means including a rotatable journal longitudinally mounted in said bearing.

6. A nozzle assembly according to claim 1, in which said mounting means enables said guide element to be adjusted in a plane to which the axis of said nozzle is perpendicular.

7. A nozzle assembly according to claim 1, in which said mounting means includes a U-shaped member and a support for said U-shaped member, said guide element being mounted on one limb of said U-shaped member and the other limb being fixed to said support transversely to the axis of said nozzle.

8. A nozzle assembly according to claim 1, in which said guide element is a sphere and said mounting means comprises an arm extending transversely to the axis of said nozzle, and a short tube fixed on one side of said arm and having an internal diameter equal to the diameter of said sphere, said guide element being mounted in said short tube.

9. A nozzle assembly according to claim 1, in which said spherical surface is presented by a frustum of a sphere based on a great circle on the sphere, said guide element being formed with a concavity within said spherical surface.

* * * * *